US005534220A

United States Patent [19]

Purnell et al.

[11] Patent Number: 5,534,220

[45] Date of Patent: Jul. 9, 1996

[54] METHOD OF SINTERING MACHINABLE FERROUS-BASED MATERIALS

[75] Inventors: Charles G. Purnell, Coventry; Mohammad S. Mahmoud, London; Helen A. Brownlie, Coventry, all of United Kingdom

[73] Assignee: Brico Engineering Limited, Coventry, England

[21] Appl. No.: 313,052

[22] Filed: Sep. 30, 1994

[30] Foreign Application Priority Data

Apr. 1, 1992 [GB] United Kingdom ..... 9207139

[51] Int. Cl.[6] ..... B22F 3/12

[52] U.S. Cl. ..... 419/45; 419/10; 419/32; 419/38; 75/228; 75/230; 75/231; 75/245; 75/246

[58] Field of Search ..... 75/228, 230, 231, 75/245, 246; 419/10, 32, 38, 45; 428/546, 551, 552, 565

[56] References Cited

U.S. PATENT DOCUMENTS

| | | | |
|---|---|---|---|
| 3,861,906 | 1/1975 | Tipnis et al. | 75/124 |
| 4,035,159 | 7/1977 | Hashimoto et al. | 75/246 |
| 5,259,860 | 11/1993 | Ikenoue et al. | 75/231 |

FOREIGN PATENT DOCUMENTS

| | | |
|---|---|---|
| 0183666 | 6/1986 | European Pat. Off. . |
| 0418943 | 3/1991 | European Pat. Off. . |
| 0480495 | 4/1992 | European Pat. Off. . |
| 3345930 | 6/1985 | Germany . |
| 2007261 | 5/1979 | United Kingdom . |

OTHER PUBLICATIONS

Patent Abstracts of Japan, vol. 6, No. 15, C–89, Abstract of 56–136953 (Kobe Seikosho K.K.) Oct. 26, 1981.

"Powder Metallurgy" 1983, vol. 26, No. 3 (Machinability of sintered steels pp. 137–144 by U. Engstrom).

*Primary Examiner*—Charles T. Jordan
*Assistant Examiner*—John N. Greaves
*Attorney, Agent, or Firm*—Synnestvedt & Lechner

[57] ABSTRACT

A method is described for the manufacture of a sintered ferrous-based material having improved machinability, the method comprises the steps of making a mixture of a ferrous-based powder, the mixture including a compound containing at least one metal from the group comprising manganese and the alkaline-earth series of metals; at least one sulphur donating material; pressing the powder mixture and sintering the pressed mixture so as to cause the formation by reaction during sintering of at least one stable metal sulphide within the sintered material. Materials and articles made by the method are also described.

21 Claims, 2 Drawing Sheets

METHOD OF SINTERING MACHINABLE FERROUS-BASED MATERIALS

The present invention relates to sintered ferrous materials, products made therefrom and to a method for their manufacture.

Machining of articles produced by a powder metallurgy route is often a significant part of the manufacturing cycle. Good machinability of an article is important as this increases tool life and reduces tooling-associated down-time during manufacturing. Valve guides for internal combustion engines, for example, are usually finish-machined by reaming after fitting in the cylinder head by the engine manufacturer who demands good machinability of the guide.

It has been found that in materials having relatively poor machinability that the working surface may be smeared by the cutting tool, resulting in closing-up or in a reduction of the surface porosity. The presence of open surface porosity is frequently used in sintered materials to provide a reservoir for the retention of lubricating oil in order to improve the anti-seizure or scuffing wear resistance of the material and so increase durability of the material or article. Furthermore, it has been found in some circumstances that a smeared surface results in a relatively low surface roughness value and which may deleteriously affect the wear resistance of articles such as valve guides when running against a smooth counterface such as a valve stem, for example.

Powder metallurgy articles are generally manufactured by pressing from a mixture of powders which may be elemental powders or pre-alloyed powders or a combination of both, followed by sintering. The powder mixture frequently includes additions to promote or enhance desired characteristics or properties of the powder mixture itself and/or the resulting sintered material. In the case of machinability, small additions of materials which act as "chip breakers" are frequently made, the most common of which is manganese sulphide. Such additions cause the cut material to break up into chips by shearing, reducing cutting load and the likelihood of build-up of material on the cutting edge of the tool. Additions such as manganese sulphide assist the machinability of the material, but however, have substantially little other beneficial effects on the strength or wear resistance, for example, of the sintered material.

Machinability may also be affected by other factors including the amount and distribution of ductile phases which may promote build-up of material on the tool during machining.

It is an object of the present invention, in its broadest sense, to provide an alternative means of providing sintered ferrous-based materials with enhanced machinability characteristics.

It is a further objective in some embodiments of the present invention to provide means of enhancing the machinability of sintered ferrous-based materials and which means also have a subsidiary effect of improving the hardness and wear properties of the material and of articles made from that material.

According to a first aspect of the present invention there is provided a method of enhancing the machinability of a sintered ferrous-based material, the method comprising the steps of (1) making a mixture of a ferrous-based powder, the mixture including (a) a chemical compound containing at least one metal from the group comprising manganese and the alkaline-earth series of metals, and (b) a sulphur donating material;(2) pressing the powder mixture and (3) sintering the pressed mixture so as to cause the formation by a chemical reaction during sintering of a sulphide of the at least one metal within the sintered material.

Manganese and alkaline-earth metal compounds having harmful effects negating the benefits described herein, on the powder mixture or pressed material before, during or after sintering, either alone or by reaction with the at least one sulphur donating material are excluded from the scope of this invention.

Advantageously, the alkaline-earth metals may be calcium or magnesium employed singly or in combination. Fine powders of compounds containing these metals are both freely available and cheap.

More advantageously, the compound containing calcium or magnesium may be a carbonate. Calcium carbonate and magnesium carbonate are found naturally together in the mineral known as dolomite. Calcium carbonate, otherwise known as chalk, occurs naturally as calcite, and magnesium carbonate as magnesite.

It is believed that under sintering conditions the alkaline-earth carbonate decomposes to the oxide which reacts with the sulphur donating material to form the alkaline-earth sulphide. Due to the nature of the mechanism of formation of the alkaline-earth sulphide, the particle size is fine and the particles are homogeneously distributed throughout the material to produce an effective improvement in machinability of the sintered material.

Because of the method of generating the metal sulphide by reaction during sintering within the structure, it is believed that the distribution of metal sulphide particles is more uniform and that the size of the particles themselves is less than that produced when a metal sulphide is added as a constituent of the powder mixture prior to pressing.

In a particularly advantageous embodiment of the method of the present invention, the sulphur donating material may be molybdenum disulphide. It has been found that during sintering the molybdenum disulphide reacts with the manganese or alkaline-earth compound to supply sulphur to form the manganese or alkaline-earth sulphide, and to cause the release of free molybdenum which reacts by diffusion with the iron and carbon of the ferrous matrix to produce molybdenum and carbon-rich areas which both strengthen and improve the wear resistance of the sintered material.

Desirably, there is an excess of the sulphur donating material to preclude the possibility that any residual alkaline-earth oxide remains in the sintered ferrous material at the conclusion of sintering. Such material when exposed to a moisture containing environment during, for example storage, may be prone to corrosion.

When the sulphur donating material is molybdenum disulphide, it is desirable to have an excess of this material for its self lubricating properties in the finished product, and also due to the inherent capability of reducing friction either during machining or in service.

The ferrous material mixture should desirably not contain more than 5 wt % of the manganese or alkaline-earth compound, as above this amount the compressibility of the mixture rapidly deteriorates. Reduction in compressibility limits the ultimate density which may be achieved in the final sintered product.

For articles such as, for example, valve guides and valve seat inserts, a minimum density of 80% of the full theoretical density is desirable in the as-pressed material to achieve a product of consistent quality. To achieve this density at realistic pressing pressures, the maximum content of the manganese or alkaline-earth compound should not be more than 3 wt %. The range of manganese or alkaline-earth compound may preferably lie in the range from 0.1 wt % to 3 wt %.

With calcium carbonate and magnesium carbonate, a range of 0.1 wt % to 3 wt % has been found effective when in combination with from 0.1 wt % to 3 wt % of molybdenum disulphide. The relative proportions desirably being chosen to ensure that at least a slight excess of molybdenum disulphide is present.

More preferably, the range of calcium carbonate and/or magnesium carbonate may lie in the range from 0.2 wt % to 1.5 wt %.

Because molybdenum disulphide is a relatively soft material and a solid lubricant, relatively greater quantities may be tolerated in the powder mixture before a serious decrease in the compressibility of the mixture is produced. The molybdenum disulphide tends to be forced into the pores of the as-pressed material during the pressing operation.

Due to the mechanical property improving effect of the liberated molybdenum, it has been found possible to employ ferrous-based powders having lower quantities of alloying additions than has heretofore been the case. This has benefits with regard to the economics of the present invention.

In order to secure maximum benefit from the liberated molybdenum, the ferrous-based mixture desirably contains carbon in order to generate alloy carbides in the sintered material. Desirably, the powder mixture may contain from 0.5 wt % to 2 wt % of carbon. The carbon may be present in pre-alloyed form in the ferrous base powder and/or in the form of graphite. In order to achieve maximum compressibility of the powder mixture, it is preferred that the major proportion of carbon is present in the form of graphite.

The ferrous base powder may contain any alloying additions desired for the intended application, provided that they do not substantially interfere with the reaction during sintering to produce the metal sulphide.

In the case of products such as valve guides, valve seat inserts and sealing rings for example, an addition of from 1 wt % to 6 wt % of elemental copper may be made to the powder mixture which addition acts as a sintering aid and also acts to inhibit adhesive wear in the finished product. Additionally, or alternatively, the ferrous-based material may be infiltrated with a copper-based material to partly or completely fill the residual porosity of the sintered material. Such infiltration may be effected either simultaneously with sintering or subsequently to sintering, in the latter case as a separate operation.

Other known additions may be made to the powder mixture, such additions including, for example, a fugitive lubricant wax to assist compaction, the wax volatilising during sintering. Additions of 0.5 wt % to 1.0 wt % of wax are commonly used.

According to a second aspect of the present invention there is provided a sintered ferrous-based material, the material having a fine distribution of particles of at least one metal sulphide distributed throughout the matrix thereof, there being substantially no particles having a maximum dimension greater than 25 μm.

Preferably, the majority of metal sulphide particles are less than 10 μm in diameter, whilst the maximum particle size is 20 μm.

In a preferred embodiment of the material of the present invention the metal sulphides may be manganese sulphide, calcium sulphide and/or magnesium sulphide.

The material has a pearlitic matrix and may also contain iron and molybdenum rich carbide regions depending on the carbon content. The matrix may also contain free molybdenum disulphide distributed throughout the pearlitic matrix.

Other phases such as copper for example may also be present as will be appreciated from the discussion above relating to the method of the present invention.

According to a third aspect of the present invention there is provided an article made by the method of the first aspect in the material of the second aspect of the present invention. The article may be produced to near-net shape by pressing and sintering, and may include for example, valve guides, valve seat inserts and sealing rings.

In order that the present invention may be more fully understood, an example will now be described by way of illustration only with reference to the accompanying drawings, of which:

Figure 1:
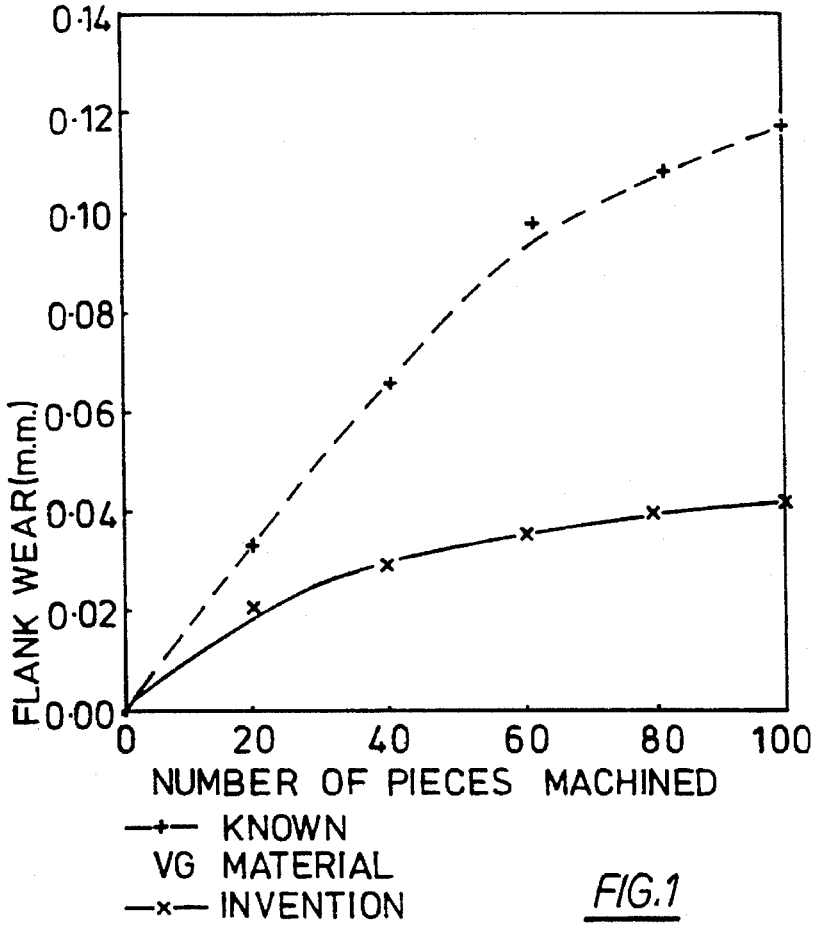
FIG. 1 shows a graph showing the variation in tool wear against the number of pieces machined for a known material and a material according to the present invention.

A ferrous-based powder mixture was prepared by mixing 93.9 wt % of iron powder with 1.1 wt % of graphite power, 1.0 wt % of molybdenum disulphide, 1.0 wt % of calcium carbonate powder, 3.0 wt % of copper powder and 0.75 wt % of a fugitive lubricant wax. The powders were mixed for 30 minutes in a Y-cone rotating mixer. Cylindrical tubes having the shape of valve guides were then pressed by double-ended pressing at a pressure of approximately 750 MPa. The pressed articles were then sintered at a temperature above 1000° C. for 20 minutes in a hydrogen and nitrogen atmosphere.

The resulting sintered articles were examined for their metallurgical structure on an optical microscope and on a scanning electron microscope. The structure comprised an essentially pearlitic matrix having molybdenum-rich zones, free copper and calcium sulphides finely and uniformly distributed throughout the matrix. The calcium sulphide particles were mostly less than 10 μm in maximum dimension, whilst there was an occasional particle up to a maximum dimension of 20 μm. The molybdenum-rich zones which were alleyed with the matrix were free from associated sulphur indicating that a reaction had taken place during the sintering operation, leading to the formation of calcium sulphide and the liberation of free molybdenum which had diffused with the iron to form the molybdenum-rich areas and some molybdenum carbide. Molybdenum disulphide associated with the porosity was also evident.

Physical measurements and mechanical tests were carried out on the pressed and sintered material. The results of these tests are shown in Table 1 below.

TABLE

| Property | Result |
|---|---|
| Sintered Density ($Mgm^{-3}$) | 6.7 |
| Hardness (HRB) | 72 |
| Rupture Strength (MPa) | 550 |
| Young's Modulus (GPa) | |
| 20° C. | 114 |
| 200° C. | 112 |
| 0.2% P.S. (MPa) | |
| 20° C. | 315 |
| 200° C. | 314 |

Machinability of the sintered cylinders after impregnation with turbine oil was also tested by measuring the tool flank wear as a function of the number of parts machined. The test procedure consisted of rotating the cylinder, which had an ID of 6.5 mm and an OD of 13 mm, about its axis in a lathe at 2300 rev/min, plunging a triangular cutting tool axially into the cylinder to a depth of 20 mm at a feed rate of 340 mm/min and measuring the tool flank wear after a predetermined number of pieces had been machined. It may be seen from FIG. 1 that the rate of tool wear with material according to the present invention was approximately only one third that of the known valve guide material after one hundred pieces were machined. The known valve guide material was a wear-resistant gray cast iron incorporating 0.75wt % phosphorus.

Figure 2:
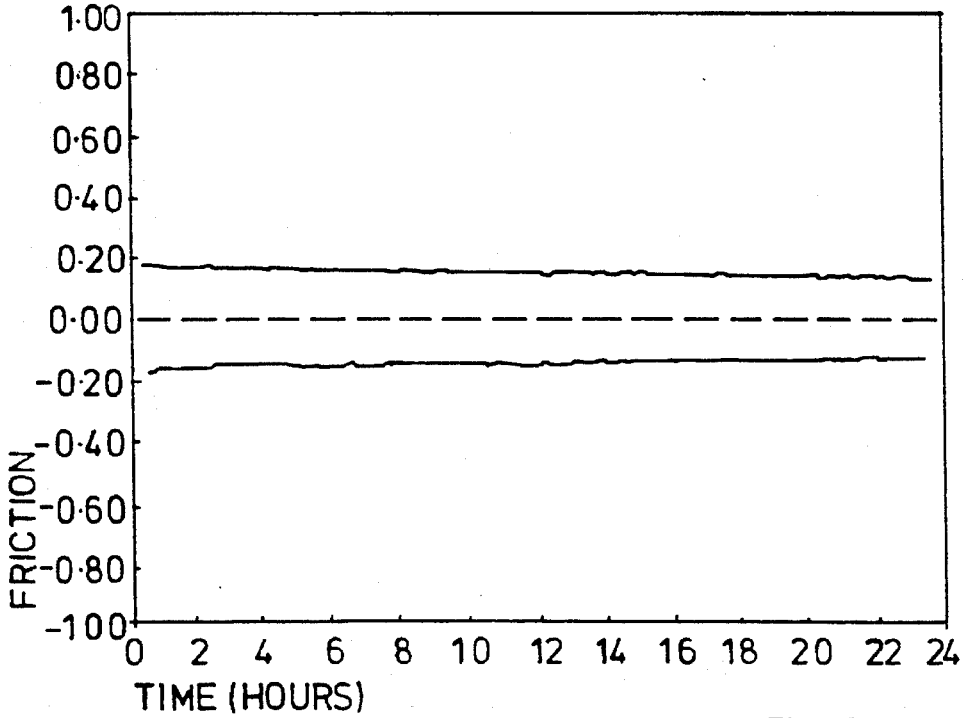
FIG. 2 shows a graph of the variation of friction with time during a wear test on a material according to the present invention.

Wear testing was also carried out. The test comprised a reciprocating sliding horizontal cylinder of the valve guide material, sliding on a horizontal piece of valve stem material, the sliding cylinder being side loaded to produce accelerated wear. A lead cell along the valve stem axis measures axial loading due to friction. This test is a severe test and simulates the wear conditions of a valve guide under cold start conditions in an engine. As may be seen from FIG. 2, the friction (ratio of axial lead to side lead) was low (the negative values merely represent the reciprocating nature of the test), indicating the good wear resistance which was obtained and the inherent lubricity of the material.

Figure 3:
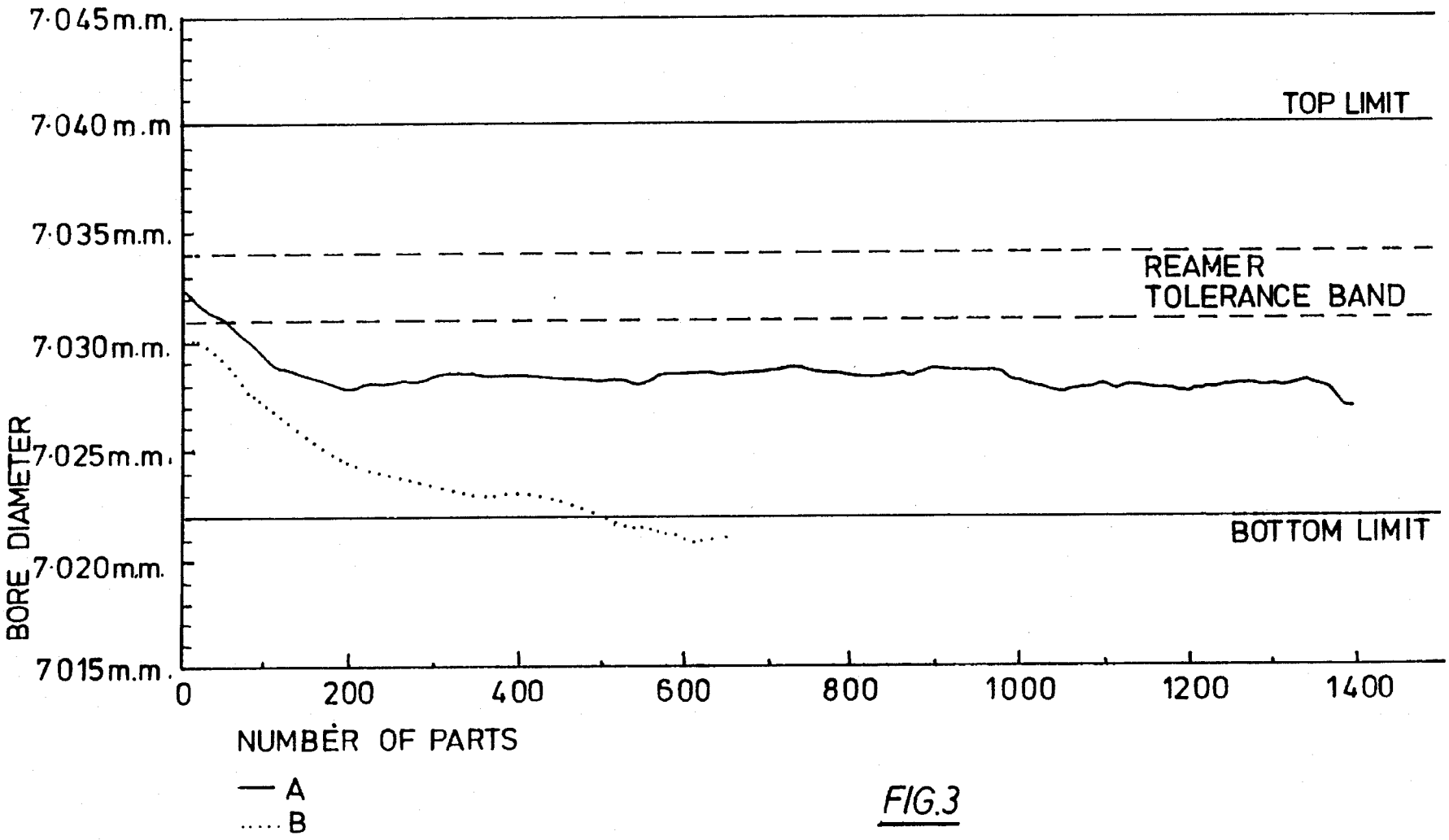
FIG. 3 which shows a graph of variation of machined bore diameter vs. number of parts machined for a material of the present invention and a known material.

Reaming trials were also carried out on pressed and sintered valve guides of length 44 mm, O.D. 13 mm and I.D. 6.5 mm. The guides were made according to the first, second and third aspects of the invention and designated Material 'A'. Material 'B'was a known valve guide material not according to the present invention. Tests were conducted with a two-flute reamer of diameter 7.031 to 7.034 mm, at a rotational speed of 2800 rev/min, feed speed of 280 mm/min using soluble lubricant. FIG. 3 shows the variation in reamed bore size of the two Materials 'A' and 'B'. It is clear from FIG. 3 that Material 'A' has a much improved consistency of reamed bore size which is itself indicative of a significant improvement in tool life.

Valve guides were made according to the present invention and tested in a 1600 cc engine fuelled by unleaded gasoline. The test cycle consisted of an initial 80hrs low speed scuff cycle followed by 200 hrs full throttle/full load operation. At the end of the test the maximum wear 5 mm from the port end of the exhaust guides, this position corresponding to the highest wear in the particular engine tested, averaged 30 μm. Over the four cylinders, average wear values of about 100 μm would be more typical of a conventional cast iron valve guide.

Further experimental trials on pressing and sintering were carried out. From these trials it could be concluded that the proportion of molybdenum disulphide had very little effect on the attainable green density and that the inclusion of calcium and/or magnesium carbonate and molybdenum disulphide and the ensuing reaction during sintering had no undesirable effects on the dimensional change on sintering. Sintered structures showed no evidence of gas porosity indicating that the decomposition of the carbonate had occurred prior to effective sintering of the ferrous matrix.

Lowering of the hardness and rupture strength occurred for the materials containing an excess of calcium or magnesium carbonate and the lower levels of molybdenum disulphide. In addition such materials smelt of hydrogen sulphide, and upon grinding and immersion of the powdered product in water, gas bubbles were evolved indicating instability against corrosion.

We claim:

1. A method of enhancing the machinability of a sintered ferrous-based material, the method comprising the steps of (1) making a mixture of a ferrous-based powder, the mixture including (a) a chemical compound of at least one metal selected from the group consisting of manganese and the alkaline-earth series of metals and (b) at least one sulphur donating material; (2) pressing the powder mixture and (3) sintering the pressed mixture so as to cause the formation, by a chemical reaction between said chemical compound and said sulphur donating material during sintering of a sulphide of the at least one metal within the sintered material, whereby fine particles of said sulphide of said metal are formed, and uniformly distributed, in said sintered material.

2. A method according to claim 1 wherein the alkaline-earth metals are selected from the group consisting of calcium and magnesium.

3. A method according to claim 1 wherein said chemical compound is a carbonate.

4. A method according to claim 1 wherein the sulphur donating material is molybdenum disulphide.

5. A method according to claim 1 wherein there is a stoichiometric excess of the sulphur donating material with regard to the metal content of said chemical compound.

6. A method according to claim 1 wherein said mixture contains up to 5 wt % of the manganese and/or said chemical compound.

7. A method according to claim 6 wherein said mixture contains from 0.1 wt % to 3.0 wt % of the alkaline-earth metal compound.

8. A method according to claim 3 wherein said mixture contains from 0.2 wt % to 1.5 wt % of the alkaline-earth metal compound.

9. A method according to claim 7 wherein said mixture contains from 0.1 wt % to 3 wt % of molybdenum disulphide.

10. A method according to claim 1 wherein said mixture further contains 0.5 wt % to 2.0 wt % carbon.

11. A method according to claim 1 wherein the pressed mixture is sintered at a temperature in the region of 1000° C.

12. A sintered ferrous-based material produced by the process of claim 1, said material having fine particles of at least one metal sulphide distributed uniformly throughout said material, there being substantially no particles having a dimension greater than 25 μm.

13. A sintered ferrous-base material according to claim 12 wherein the majority of metal sulphide particles are less than 10 μm in maximum dimension, whilst the maximum particle size is 20 μm.

14. A sintered ferrous-based material according to claim 12 wherein said metal sulphide is selected from the group consisting of manganese sulphide, calcium sulphide and magnesium sulphide.

15. A sintered ferrous-based material according to claim 12 which also includes molybdenum-rich areas.

16. A sintered ferrous-base material according to claim 15 which also contains free molybdenum disulphide.

17. A sintered ferrous-base material according to claim 12 which contains pearlite.

18. A sintered ferrous-base material according to claim 12 which also contains from 1 wt % to 6 wt % of copper.

19. A sintered ferrous-base material according to claim 12 which comprises a porous matrix that is infiltrated with a copper-base material.

20. An article of manufacture comprising a ferrous-base material according to claim 12.

21. An article of manufacture according to claim 20 which is selected from the group consisting of valve guides, valve seat inserts and sealing rings.

* * * * *

UNITED STATES PATENT AND TRADEMARK OFFICE

CERTIFICATE OF CORRECTION

PATENT NO. : 5,534,220
DATED : July 9, 1996
INVENTOR(S) : Purnell et al

It is certified that error appears in the above-indentified patent and that said Letters Patent is hereby corrected as shown below:

On the title page:

Please add the following

[22] PCT Filed: February 24, 1993

[86] PCT No.: PCT/GB93/00380
§371 Date: September 30, 1994
§102(e) Date: September 30, 1994

[87] PCT Pub. No.: WO 93/19875
PCT Pub. Date: October 14, 1993

Column 4, line 38, change "alleyed" to --alloyed--

Signed and Sealed this

Fourth Day of March, 1997

*Attest:*

Bruce Lehman

BRUCE LEHMAN

*Attesting Officer*

*Commissioner of Patents and Trademarks*